United States Patent [19]

Flanagan et al.

[11] Patent Number: 4,664,459

[45] Date of Patent: May 12, 1987

[54] NOISELESS SOLID CONDUCTOR FLEXIBLE CABLE

[75] Inventors: Peter F. Flanagan, Cranston; Nicholas L. Lizza, Exeter, both of R.I.

[73] Assignee: Raytheon Company, Lexington, Mass.

[21] Appl. No.: 861,642

[22] Filed: May 2, 1986

Related U.S. Application Data

[63] Continuation of Ser. No. 667,510, Nov. 1, 1984, abandoned.

[51] Int. Cl.[4] ..... H01R 11/00

[52] U.S. Cl. ..... 339/28; 174/117 FF; 174/121 AR

[58] Field of Search ..... 339/17 F, 176 MF, 28, 339/29, 278 CT; 174/117 FF, 121 AR, 121 SR, 121 R

[56] References Cited

U.S. PATENT DOCUMENTS 1,487,937 3/1924 Griffin ..... 339/28

3,588,318 6/1971 Ollis ..... 174/121 AR

*Primary Examiner*—Gil Weidenfeld

*Assistant Examiner*—Paula A. Austin

*Attorney, Agent, or Firm*—Martin M. Santa; Richard M. Sharkansky

[57] ABSTRACT

The cable of this invention comprises a pair of solid, flat, flexible electrical conductors of beryllium-copper attached to a reinforcing webbing of braided nylon. The ends of the conductors are soldered to electrical connector sockets and pins which are supported by glass reinforced resin disks. The webbing is tensioned while being molded inside a water impermeable elastomer which also encompasses the conductors, disks, and end portion of the sockets and pins. A second molding operation covers the water impermeable elastomer with a tough elastomer to form the cable including integral connector bodies incorporating the sockets and pins.

29 Claims, 15 Drawing Figures

NOISELESS SOLID CONDUCTOR FLEXIBLE CABLE

This application is a continuation of application Ser. No. 667,510 filed Nov. 1, 1984 now abandoned.

BACKGROUND OF THE INVENTION

Underwater transducers such as are used in sonar systems undergoing substantial changes in water pressure are required to be "quiet". That is, the noise levels generated by the transducers must be below some predetermined threshold. One of the sources of noise has been found to be in the cable which connects the transducer to a "penetrator" connector which penetrates the hull of the vessel on which the transducer is mounted. It is believed that the wire strands which make up the individual conductors in the prior art electrical cable move against each other in such a way as to cause unacceptably high acoustic noise emissions during hydrostatic pressure change. The relative motion of one strand upon another is therefore highly undesirable if a "quiet" environment is to be reliably obtained. A conventional round solid conductor electrical cable would avoid the problem generated by the strands but such a cable will not withstand the flexing rigors produced with a subsurface ship environment. Therefore, a solid-wire, yet flexible, underwater electrical cable is needed to satisfy both noise and mechanical reliability problems. The cable of this invention has the properties which overcome both these problems as will be apparent from the following description of the invention.

SUMMARY OF THE INVENTION

The aforementioned problems are overcome by the cable of this invention which comprises a pair of solid, flat, flexible electrical conductors of beryllium-copper attached to a reinforcing webbing of braided nylon. The ends of the conductors are soldered to electrical connector sockets and pins which are supported by glass reinforced resin disks. The webbing is tensioned while being molded inside a water impermeable elastomer which also encompasses the conductors, disks, and resin end portion of the sockets and pins. A second molding operation covers the water impermeable elastomer with a tough elastomer to form the cable including integral connector bodies incorporating the sockets and pins.

BRIEF DESCRIPTION OF THE DRAWINGS

The aforementioned objects and other features of the invention are explained in the following description taken in conjunction with the accompanying drawings wherein.

DESCRIPTION OF THE PREFERRED EMBODIMENT

Figure 1:
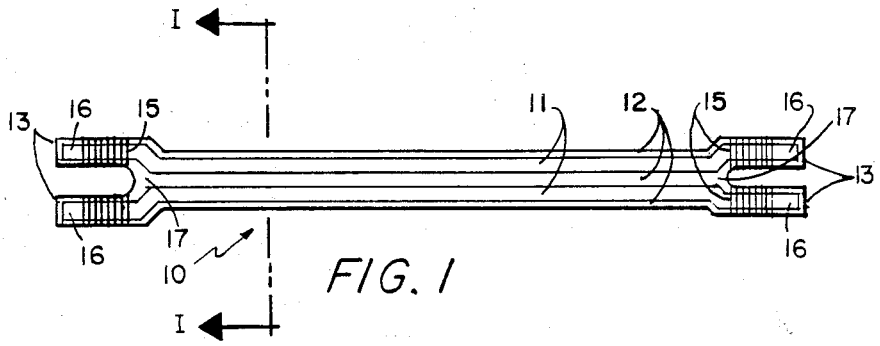
FIG. 1 is a top planar view of the electrical conductors used in the cable of this invention.
Figure 1A:
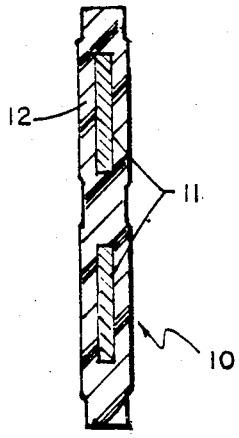
FIG. 1A is a cross-sectional view of the conductors of FIG. 1 taken along section line I—I.
Figure 5A:
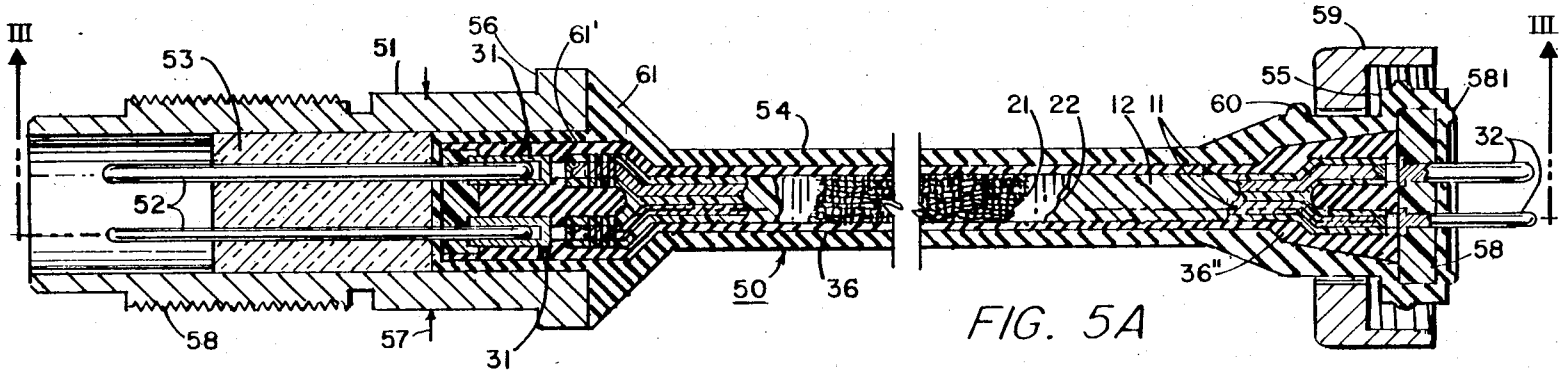
FIGS. 5A and 5B are longitudinal sectional views taken along section lines II—II of FIG. 5B and III—III of FIGS. 5A and 5C, respectively.

The cable of this invention utilizes as its solid conductors a pair of thin narrow elongated conductors 11 of FIG. 1 which are bonded between flexible plastic coatings 12 which insulate and hold the conductors 11 relative to one another to form a conductor 10. The ends 13 of conductor 10 are forked to increase the spacing of conductors 11 to correspond to the spacing of the pins 31, 32 at the ends of the conductor 10 as shown in FIG. 5A. Each conductor 11 has a corrugated portion 15 between the region 17 at which the conductors 11 diverge and the ends 13 of the conductors 11. The ends 13 of the conductors 11 have the coating 12 on only one side. The other side of conductors 11 at the ends 13 are coated with a layer of solder 16 for subsequent attachment to connector sockets 31 and pins 32. In a typical cable of this invention, the conductors 11 are each typically $\frac{1}{8}$ inch wide strips of 3-oz./ft$^2$ beryllium-copper conductor. The plastic insulator 12 is typically Kapton. A conductor 10 of this configuration is commercially available from the Teledyne Corporation and is known by the trade name "Flexcircuit". FIG. 1A shows a cross-section of conductor 10 taken along section lines I—I of FIG. 1. The commercially available form comes without the corrugated portions 15. The corrugated portions 15 are formed to allow the cable 50 of FIG. 5C of which conductor 10 is a part to stretch by elongation of the corrugated portion 15 without elongating that portion of the conductor 10 between regions 17. The width of the conductor 10 including the insulator 12 is substantially $\frac{3}{8}$ inch in the central portion (between regions 17) of the conductor 10 and $\frac{1}{2}$ inch at the ends. The thickness of conductor 10 is approximately 1/64 inch and the length is approximately 5 inches.

Figure 2:
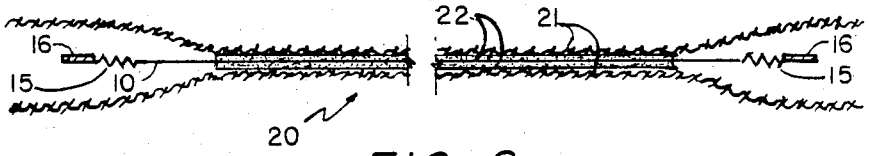
FIG. 2 is a longitudinal cross-sectional view of the conductor of FIG. 1 with a webbing reinforcement.

In order to provide less tensile stress to the conductor 10, a nylon webbing 21 is bonded by an adhesive 22 to both sides of conductor 10 between the regions 17 but not to the corrugated portion 15. The nylon webbing 21 is substantially the same width as that of conductor 10; namely, $\frac{3}{8}$ inch and 1/64 inch thickness. The web 21 is typically made of commercially available woven nylon (Part No. 7203, Elizabeth Webbing Mills, Pawtuckett, R.I.) whose width and thickness is chosen to provide the desired amount of strength to the composite conductor 20 of FIG. 2. Typically, a cable made with webbing of these dimensions will support a repeated test load of greater than 100 pounds, without the conductor 10 failing. This load condition provides much greater elongation forces than are anticipated to be exerted on the cable of the invention. Preferably, bonding of the nylon web 21 to the conductor 10 is obtained by using an adhesive. A commercially available flexible acrylic adhesive 22, such as Pyralux made by the E. I. Dupont Company, is suitable. Alternatively, the adhesive 22 may be provided by a thin strip of uncured rubber between the conductor 10 and the nylon web 21, which is heated to cause a rubber bond between these two elements. Other types of adhesives may be used, if desired.

Figure 3:
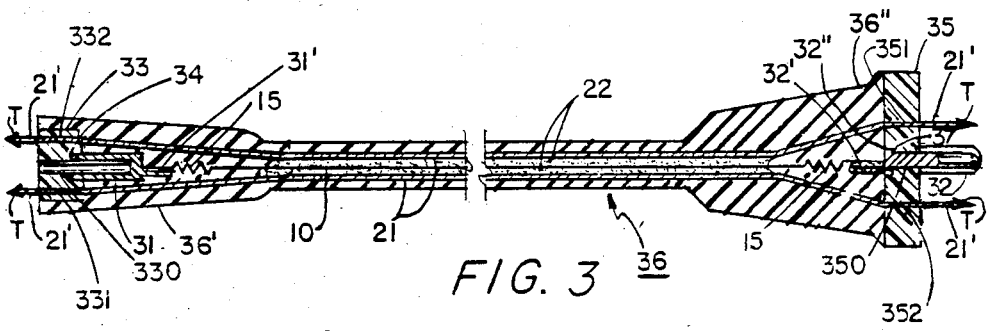
FIG. 3 is a longitudinal cross-sectional view of the "premold" assembly.

The next step in the fabrication of the cable is to solder the ends 13 at one end of conductor 10 to female sockets 31 shown in side cross-sectional view in FIG. 3. The ends 13 at the other end of conductor 10 are soldered to male pins 32. The sockets 31 and pins 32 have their respective ends 31', 32' flattened in order to provide a soldering surface for the solder 16 of the flat ends 13 of conductor 10.

A socket support disk 33 slips over the end of socket 31. Disk 33 has a pair of holes 330, each hole 330 having a diameter equal to the inner diameter of the socket 31 and a concentric hole recess 331 having a diameter equal to the external diameter of socket 31. The disk 33 is hard and strong, typically fiberglass impregnated with resin (typically commercially available "G-10" material ¼ inch in thickness provides suitable strength and thickness). At the other end of the conductor 20, the male pins 32 are supported by a fiberglass resin (G-10) impregnated disk 35 having a pair of holes 350 spaced from each other by the spacing of pins 32 and each hole slightly larger than the diameter of the pins 32. Disk 35 is slid onto pins 32 until its recess 37 concentric with the hole 350 abuts the pin 32 protrusion 32" which is located near pin end 32' which is soldered to conductor 10. Disk 33 has slots 331, 332 (shown in FIG. 6B) which are slightly larger than the width and thickness of webbing 21 which is threaded through these slots. The disk 35 also has a pair of slots 351, 352 through which the nylon webbing 21 is threaded.

The preceding assembly is placed in a mold (not shown) where the disks 33, 35 bottom on opposite ends of the mold. The mold at one end has a pair of male pins (not shown) which penetrate the disk 33 and sockets 31 in order to maintain them in planar alignment. The other end of the mold has cylindrical recesses to receive that portion of the pins 32 which project beyond the disk 35 thereby orienting the pins 32 to be in planar alignment with each other and with the sockets 31 at the other end of the mold.

The interior of the mold corresponds to the exterior of the rubber "premold" cable 36 shown in FIG. 3, so called because a second molding operation follows after the "premold" cable 36 is formed. Prior to and during the time during which the premold cable 36 is formed within the mold, the nylon webs 21 are held under slight tension T by having each web exit the ends of the mold through two slits at each end of the mold. The slits are sufficiently large to allow the nylon webs to pass through the mold while preventing the rubber material forming the premold structure 36 from substantially penetrating the mold or coating the portions 21' of the nylon webs exterior to the disks 34, 37. The amount of tension on the nylon webs need only be sufficient to keep them substantially taut between the region 17 where they are adhesively secured to the conductor 10 and the disks 33 and 35, respectively. The molding operation is accomplished by injecting an elastomer such as a rubber or a chlorosulfanated polyethylene, such as Hypalon made by the E. I. Dupont Company, into the mold to fill the void within the mold and having at least one vent in the mold which allows entrapped air to exit the mold in accordance with conventional rubber molding processes. Hypalon is preferred because it has good water permeation resistant properties. However, it has poor abrasion resistance and must be protected as described subsequently. The injection takes place under reasonably high pressure and tensioning of the nylon webs 21 is required to prevent the tautness of the webs from slackening by deviating from a straight line during the molding process. After completion of the molding step, the mold is opened and excess rubber extruded into the mold partings and vents is removed from the premold cable 36. The nylon webbing 21' is cut back to a quarter of an inch from the disks 34, 37, folded back onto the disks, and glued to the disks as shown in FIG. 6B thereby further anchoring the webbing 21".

Figures 4A, 4B:
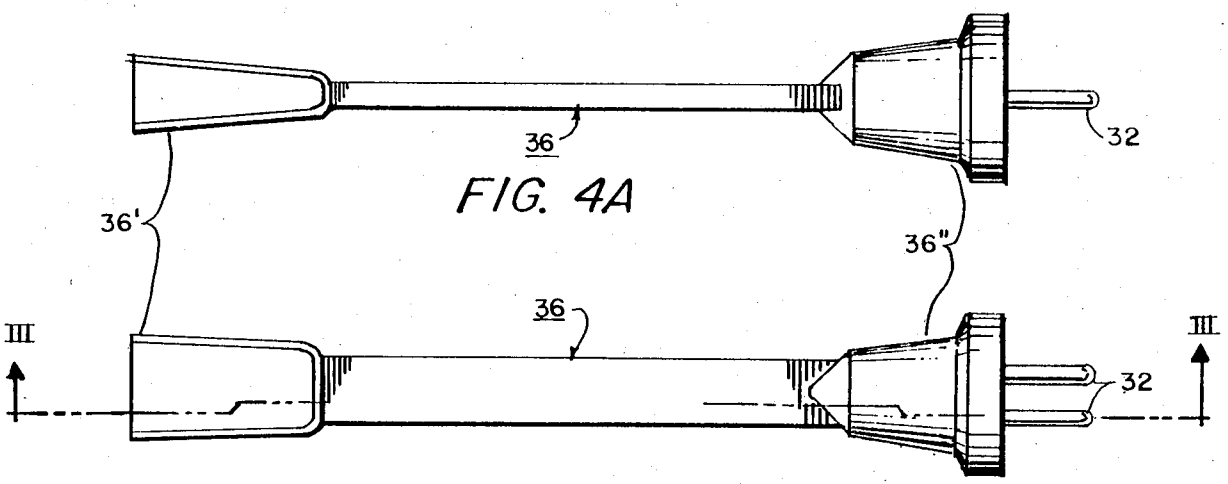
FIGS. 4A and 4B are side and top planar views of the "premold" assembly, respectively.

The premold assembly 36 is shown in cross-section in FIG. 3 taken along the section line III of FIGS. 4B, 5A which shows a top view and sectional top view of the premold cable 36, respectively. A side and top view of the premold cable is shown in FIGS. 4A, 4B, respectively. It is seen that the end 36' containing the sockets 31 of the premold cable 36 is substantially rectangular and hence its disks 33, 34 are also rectangular whereas the end 36" of the premold assembly 36 is round and hence the disks 35 are also round. End 36' could be round in cross-section, if desired.

Figure 5B:
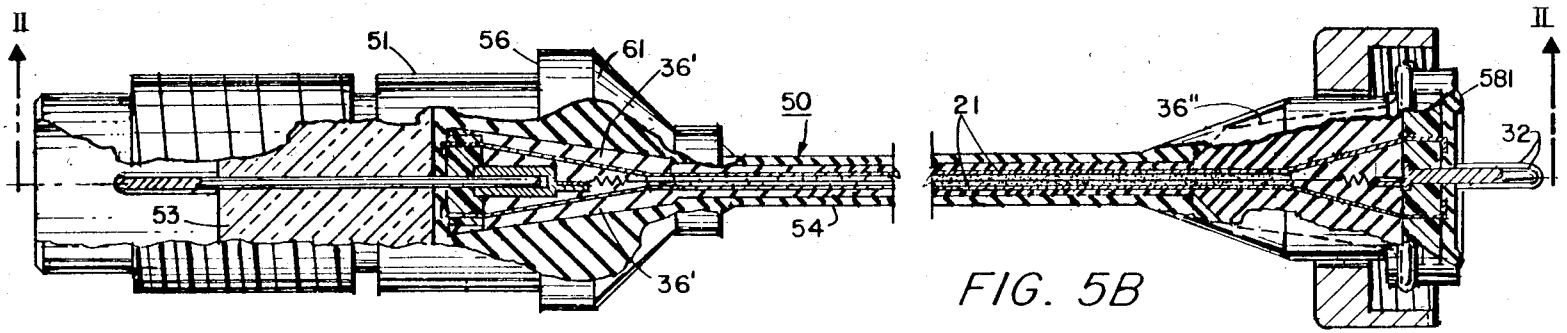
Figure 5C:
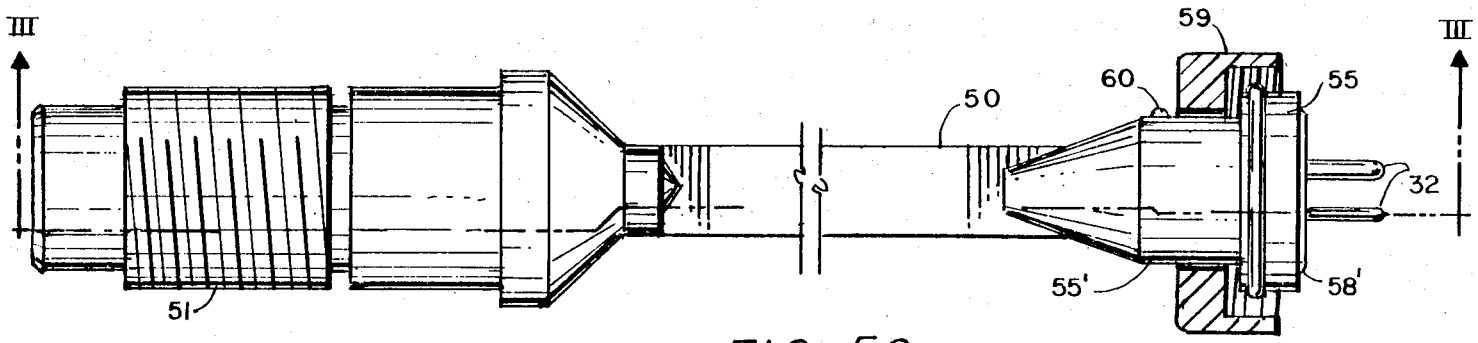
FIG. 5C is a top planar view of the cable of this invention.

The completed cable assembly 50 is shown in cross-sectional views in FIGS. 5A, 5B and in a top view in FIG. 5C. FIG. 5B is a sectional view taken along the section line II—II of FIG. 5C whereas FIG. 5A is the sectional view on line III—III taken transverse to the plane through the sockets 31 and connector pins 32. In order to make the cable assembly 50 from the premold cable 36 of FIG. 3, a stainless steel through-hull penetrator 51 containing a pair of male connector pins 52 in alignment with the sockets 31 and making connection therewith is held in alignment by means of the glass seal 53 within the inner diameter of the penetrator 51. After the premold cable 36 has had its sockets 31 attached to the pins 52 of the penetrator 51, the assembly is inserted into a mold (not shown) for the purpose of providing an overmold 54, typically of Neoprene rubber which covers and secures the premold cable 36 to the penetrator 51 and which provides a connector 55 of the Neoprene rubber. The mold at one end allows the penetrator 51 to seat on its shoulder 56 where the mold has a hole of diameter equal to the diameter 57 of the penetrator 51. A nut (not shown) on the exterior of the mold engages penetrator threads 58 and is tightened to cause shoulder 56 to bottom tightly against the interior of the end wall of the mold. The other end of the mold has cylindrical holes which accept the connector pins 32 to a depth which leaves a space between the outermost face of disk 35 and the inner end of the mold thereby allowing Neoprene rubber to cover the face of disk 35 to form a connector end seal 581.

The mold is also constructed to allow a connector nut 59 to be inserted around the disassembled mold so that after removal of the mold the nut 59 may be slid over the nut retaining protrusion 60 molded into the overmold connector body 55' and thus be in position to secure the connector 55 to a female connector (not shown). The material of the connector nut 59 is preferably of brass or similar material or a hard plastic.

After the premold cable 36, the penetrator 51 and the pins 32 have been inserted into the mold, Neoprene rubber is forced into the cavity of the mold to form the overmold cable 54 which includes a region 61 which bonds the premold cable 36 to the penetrator 51 and which also includes the cable end 55. After the Neoprene rubber has cured, the mold is removed and the nut 59 slid over the cable end protrusion 60 to provide the completed cable 50 shown in plan view in FIG. 5C.

The preceding detailed description of the cable 50 construction illustrates a preferred embodiment of the invention. An alternate form of construction (not shown) eliminates the female sockets 31 and instead utilizes a penetrator 51 whose pins 52 have been flattened at one end and are of a material which allows the soldered ends 16 of the conductors 10 to be soldered directly to the ends of penetrator pins 52. In this event, the premold structure 36 would be fabricated with an inner portion 61' of region 61 formed in the first premold assembly of Hypalon and the outer portion of region 61 would be formed in the second molding stage using Neoprene rubber.

In order to improve the bond strength of the Neoprene overmold cable 54 to the Hypalon material of the premold cable 36 and to the penetrator 51, coatings of the primers Thixon 101 and Chemloc 205, 220 may be applied to these component parts prior to forming the outer mold 54 Neoprene layer of cable 50.

Figure 6A:
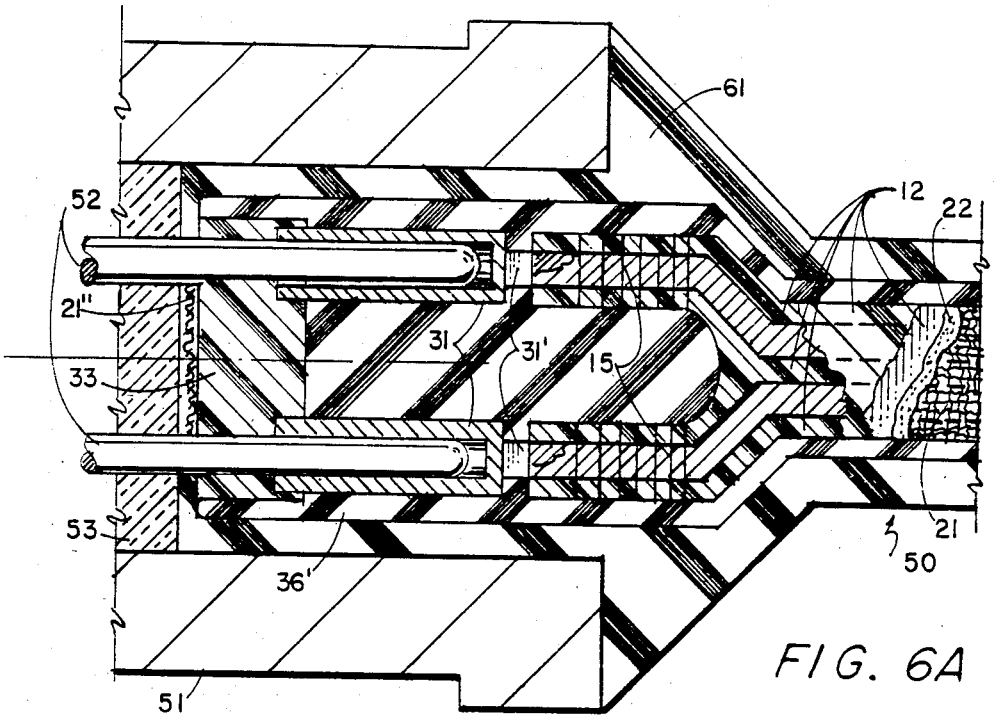
FIGS. 6A and 6B are detailed partial cross-sectional views of the penetrator 51 shown in FIGS. 5A, 5B, respectively, showing the corrugated embodiment of conductor 10 of FIG. 1.
Figure 6B:
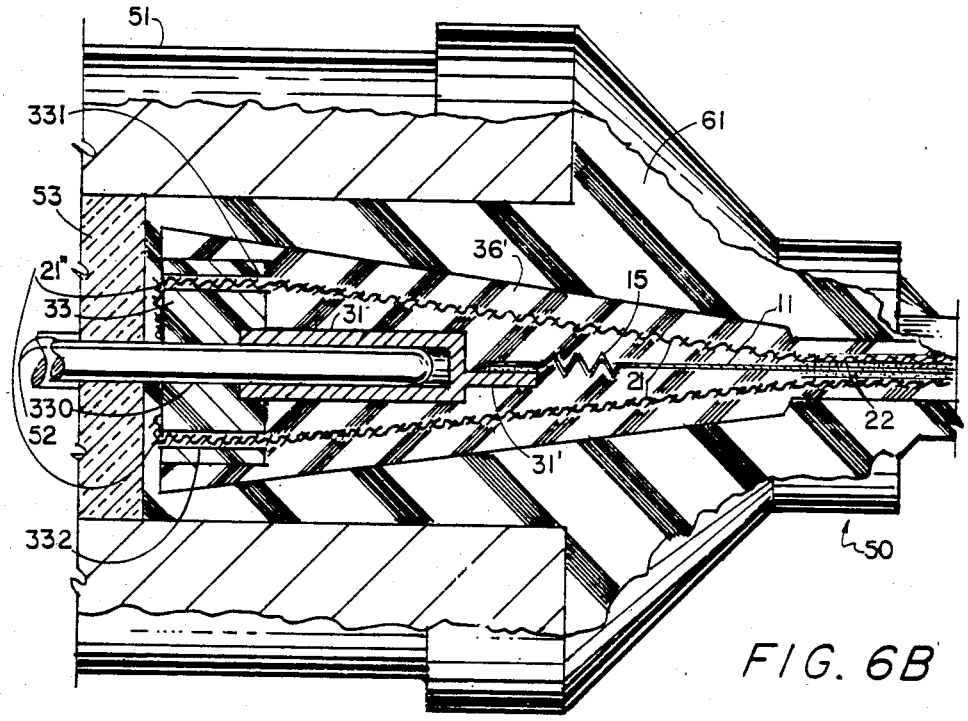

Detailed cross-sectional views of the penetrator 51 end of the cable 50 are shown in FIGS. 6A, 6B corresponding respectively to the cross-sectional views shown in FIGS. 5A, 5B. FIGS. 6A and 6B show more clearly the details of the manner in which the conductor 10 is soldered to the pins. These figures also show more clearly the slots 331, 332 in the disk 33 through which the webbing 21 passes and the folded over webbing 21'' is secured to the disk 33.

Figure 7A:
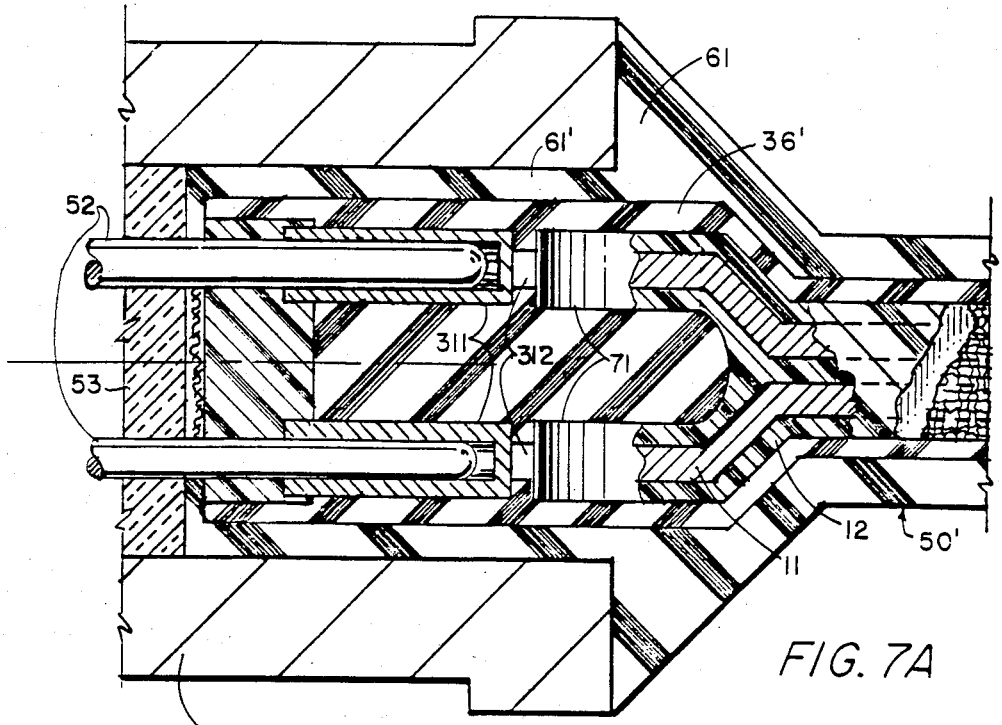
FIGS. 7A and 7B are detailed partial cross-sectional top and side views, respectively, of the penetrator 51 showing the looped ends of conductor 10 of a second preferred embodiment of the cable of this invention.
Figure 7B:
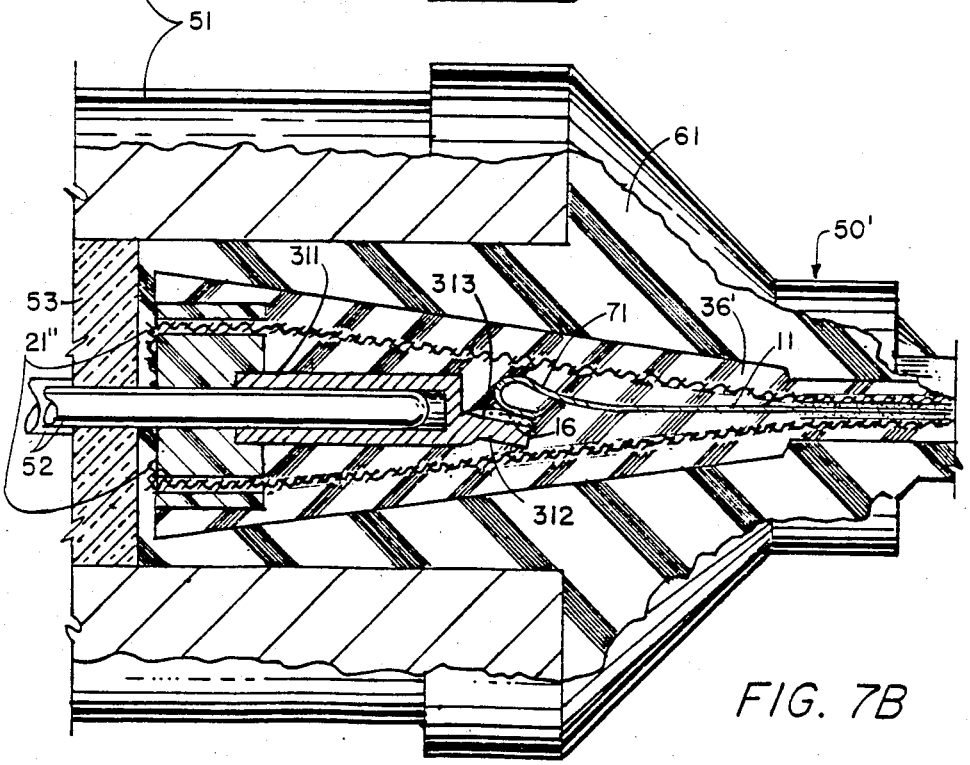
Figure 8A:
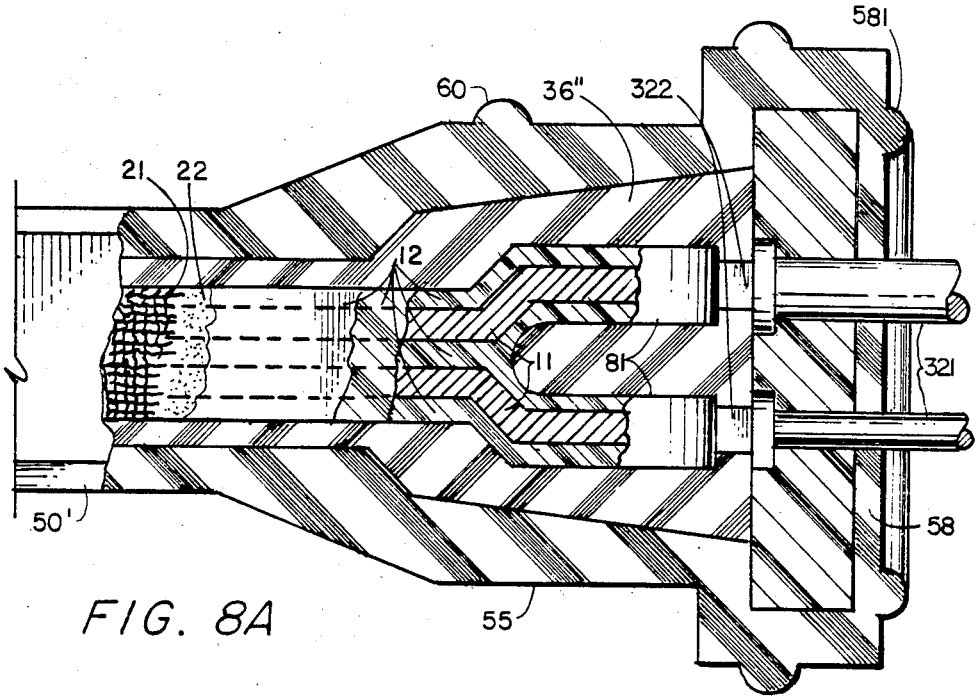
FIGS. 8A and 8B are detailed partial cross-sectional top and side views, respectively, of the pin connector end of the looped end of the second preferred embodiment of the cable of this invention.
Figure 8B:
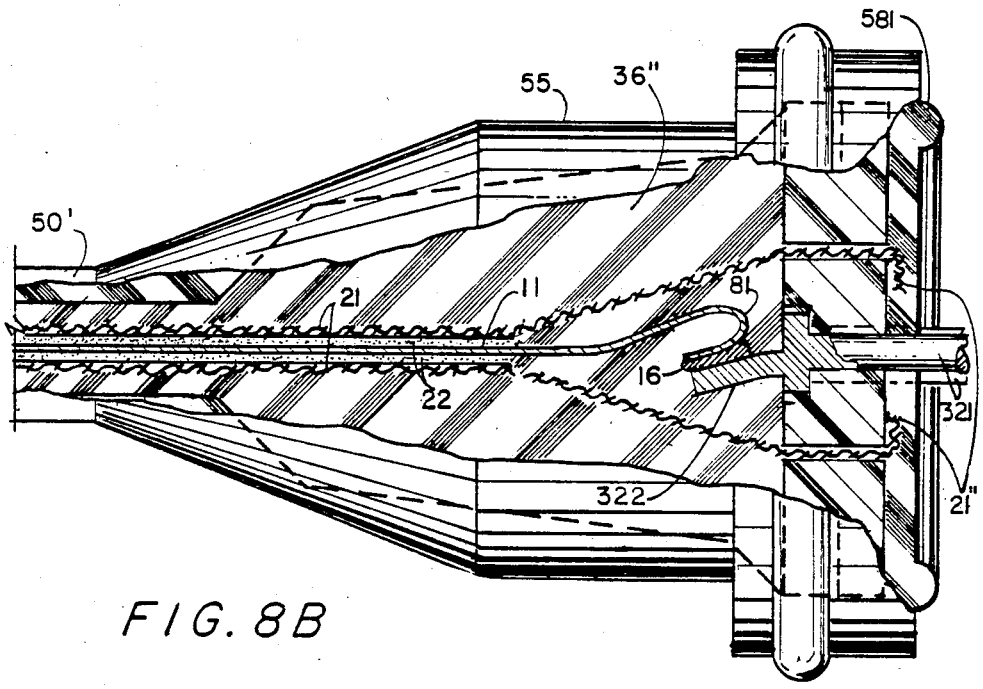

FIGS. 7A and 7B show a preferred embodiment of the end portions of a modified cable 50' at the penetrator 51 end and FIGS. 8A and 8B show the cable 50' at the connector 55 end. In the cable 50' embodiments of FIGS. 7A, 7B, 8A and 8B, the conductor 10 is not corrugated at its ends but is instead formed into a loop 71. It has been found experimentally that the cable 50' is capable of withstanding repeated cycling of tensioning of greater than 100 pounds without failure whereas the cable 50 incorporating the corrugated section 15 is not quite so durable. It is for this reason that the cable 50' is preferred over that of cable 50.

Referring to FIGS. 7A and 7B, it is observed that the sockets 311 at the penetrator 51 end of the cable 50' has been modified from that shown in FIG. 6B in that its end 312 has its flat surface 313 at an angle relative to the axis (not shown) of the socket 311. The angled flat surface 313 allows the bend or loop 71 to be made within the confines of the premold cable end 36' while keeping the radius of the loop 71 larger than if the surface 313 were parallel to the axis of the socket 311. Keeping the radius of the loop 71 large reduces the possibility of work hardening of the copper-beryllium conductor 10 and contributes to the capability of the conductor to withstand repeated stressing without fracturing and causing an electrical discontinuity in the conductor 10. The same comments apply to the loop 81 of conductor 10 at the connector 55 of the cable 50' shown in the top and side cross-sectional views of FIGS. 8A and 8B, respectively. The pins 321 are seen to have their flattened ends 322 also angled with respect to the axis of the pins 321 thereby decreasing the amount of bend and thereby increasing the radius of the loop 81 of the conductor 10. The remainder of the cable 50' is fabricated in the same way as the cable 50 which has been described in detail earlier in this specification.

It is to be understood that the above-described embodiment of the invention is illustrative only and that modifications thereof may occur to those skilled in the art. Accordingly, it is desired that this invention is not to be limited to the embodiment disclosed herein but is to be limited only as defined by the appended claims.

What is claimed is:

1. An electrical cable comprising:

a first flat, thin, flexible first electrical conductor with corrugations at the ends transverse to its length;

a first and second electrical connector, one connector having at least one electrically conducting pin and the other connector having at least one electrically conducting socket connected to the ends of said first conductor, respectively;

a first and second electrically insulating disk, each having holes corresponding to the pins and sockets connected to the ends of said first conductor, respectively;

a flexible ribbon material flexibly adhesively connected to said first conductor between the corrugated ends and tautly attached between said first and second connector; and a first elastomeric coating surrounding said ribbon, and first electrical conductor, and forming said first and second connectors to provide an abrasion-resistant, water impermeable coating.

2. The electrical cable of claim 1 comprising in addition:

said ribbon material being a webbing material.

3. The electrical cable of claim 2 comprising in addition:

said webbing material being a nylon webbing.

4. The electrical cable of claim 1 comprising in addition:

said first electrical conductor comprising second and third electrical conductors;

said second and third conductors being co-planar and fixedly attached to each other;

said second and third electrical conductors being attached to said ribbon material along at least a portion of said second and third conductors.

5. The electrical cable of claim 4 comprising in addition:

said second and third conductors having slack portions between the region of attachment of said ribbon material and said first and second electrical connectors, respectively.

6. The electrical cable of claim 5 wherein said slack portions of said second and third conductors are in the form of corrugated portions of said second and third conductors.

7. The electrical cable of claim 5 wherein said slack portions of said second and third conductors are in the form of looped portions of said second and third conductors.

8. An electrical cable comprising:

a flat, thin, flexible first electrical conductor;

a first and second electrical connector, one connector having at least one electrically conducting pin and the other connector having at least one electrically conducting socket connected to the ends of said first conductor, respectively;

a flexible ribbon material tautly attached between said first and second connector;

a first elastomeric coating surrounding said ribbon, first electrical conductor, and forming said first and second connectors to provide an abrasion-resistant, water impermeable coating;

a first and second electrically insulating disk, each disk having holes corresponding to the pins and sockets connected to the ends of said first conductor, respectively;

said pins and sockets penetrating their respective disk holes to thereby maintain a prescribed spacing from each other respectively;

each of said disks also having at least one slot through which said ribbon material passes and is secured to the face of said disks;

said first elastomeric coating comprising a second and third elastomeric coating;

said second elastomeric coating covering said first conductor, a portion of said connector pins and sockets and a portion of said disks, and the ribbon material between said disks to form a water impermeable covering; and said third elastomeric coating covering said second elastomeric coating and the faces of said disks, to form an abrasion-resistant cover and integral said first and second connectors.

9. An electrical cable comprising:

a planar, flexible first and second electrical conductors;

said first and second conductors being in the same plane;

an electrical insulator coating holding said first and second conductors in fixed relationship to one another in said plane;

first and second disks supporting connector pins and sockets respectively at a predetermined separation of said pins and said sockets;

said first and second conductors diverging from each other at their ends to correspond to the separation of said pins and said sockets and connected at their ends to said pins and sockets, respectively;

a material attached to said electrical insulator between the regions of said first and second conductors at which they diverge;

said material being taut between said first and second disks and the regions at which said first and second conductors diverge;

a water impermeable elastomer covering said first and second conductors, a portion of said pins and sockets, and a portion of said first and second disks;

an abrasion-resistant elastomer covering said water impermeable elastomer and the portion of said first and second disks not covered by said water impermeable elastomer to form a cable having connector ends containing said pins and sockets, respectively, and said first and second conductor portion between said connectors.

10. The electrical cable of claim 9 wherein:

said electrical insulator coating is a plastic.

11. The electrical cable of claim 9 wherein:

said water impermeable elastomer is chlorosulfanated polyethylene; and said abrasion-resistant elastomer is Neoprene rubber.

12. The electrical cable of claim 9 wherein:

said first and second disks have holes therethrough in a plane parallel to the plane of said first and second conductors for said supporting of said connector pins and sockets;

said first and second disks also having slots therethrough, one on each side of the holes, said slots being parallel to the plane of said holes;

said material being a planar ribbon of dimensions smaller than said slots to allow said material to pass through said slots; and said water impermeable elastomer securing said ribbon material to said disks and maintaining said material taut between said disks and said regions of said first and second conductors to which said material is attached.

13. The electrical cable of claim 12 comprising in addition:

said ribbon being adhesively attached to a face of each of said disks.

14. The electrical cable of claim 12 wherein:

said ribbon material is a nylon webbing.

15. The electrical cable of claim 12 wherein:

said first and second conductors are corrugated in the region between said disks and said region where said material is attached to said electrical insulator.

16. The electrical cable of claim 12 wherein:

said first and second conductors are in the form of a loop in the region between said disks and said region where said material is attached to said electrical insulator.

17. An electrical cable comprising:

a first flat, thin, flexible first electrical conductor;

a first and second electrical connector, one connector having at least one electrically conducting pin and the other connector having at least one electrically conducting socket connected to the ends of said first conductor, respectively;

a first and second electrically insulating disk, each having holes corresponding to the pins and sockets connected to the ends of said first conductor, respectively;

a flexible ribbon material adhesively connected to said first conductor; and a first elastomeric coating surrounding said ribbon, and first electrical conductor, and forming a first portion of said first and second connectors to provide an abrasion-resistant, water impermeable coating.

18. The electrical cable of claim 17 comprising in addition:

said ribbon material being a webbing material.

19. The electrical cable of claim 18 comprising in addition:

said webbing material being a nylon webbing.

20. The electrical cable of claim 17 comprising in addition:

said first electrical conductor comprising second and third electrical conductors;

said second and third conductors being co-planar and fixedly attached to each other;

said second and third electrical conductors being attached to said ribbon material along at least a portion of said second and third conductors.

21. The electrical cable of claim 20 comprising in addition:

said second and third conductors having slack portions between the region of attachment of said ribbon material and said first and second electrical connectors, respectively.

22. The electrical cable of claim 21 wherein said slack portions of said second and third conductors are in the form of corrugated portions of said second and third conductors.

23. The electrical cable of claim 21 wherein said slack portions of said second and third conductors are in the form of looped portions of said second and third conductors.

24. An electrical cable comprising:

a flat, thin, flexible first electrical conductor;

a first and second electrical connector, one connector having at least one electrically conducting pin and the other connector having at least one electrically conducting socket connected to the ends of said first conductor, respectively;

a flexible ribbon material attached to said first electrical conductor;

a first elastomeric coating surrounding said ribbon, first electrical conductor, and forming said first and second connectors to provide an abrasion-resistant, water impermeable coating;

a first and second electrically insulating disk, each disk having holes corresponding to the pins and sockets connected to the ends of said first conductor, respectively;

said pins and sockets penetrating their respective disk holes to thereby maintain a prescribed spacing from each other respectively;

each of said disks also having at least one slot through which said ribbon material passes and is secured to the face of said disks;

said first elastomeric coating comprising a second and third elastomeric coating and a bonding coating;

said second elastomeric coating covering said first conductor, a portion of said connector pins and sockets and a portion of said disks, and the ribbon material between said disks to form a water impermeable covering;

said bonding coating covering said second elastomeric coating and said first and second disks; and said third elastomeric coating covering said bonding coating, to form an abrasion-resistant cover and integral said first and second connectors.

25. An electrical cable comprising:

a planar, flexible first and second electrical conductors;

said first and second conductors being in the same plane;

an electrical insulator coating holding said first and second conductors in fixed relationship to one another in said plane;

first and second disks supporting connector pins and sockets respectively at a predetermined separation of said pins and said sockets;

said first and second conductors diverging from each other at their ends to correspond to the separation of said pins and said sockets and connected at their ends to said pins and sockets, respectively;

a reinforcing material attached to said electrical insulator between the regions of said first and second conductors at which they diverge;

a water impermeable elastomer covering said first and second conductors, a portion of said pins and sockets, and a portion of said first and second disks; and an abrasion-resistant elastomer covering said water impermeable elastomer and the portion of said first and second disks not covered by said water impermeable elastomer to form a cable having connector ends containing said pins and sockets, respectively, and said first and second conductor portion between said connectors.

26. The electrical cable of claim 25 wherein:

said material is a nylon webbing.

27. The electrical cable of claim 25 wherein:

said water impermeable elastomer is chlorosulfanated polyethylene; and said abrasion-resistant elastomer is Neoprene rubber.

28. The electrical cable of claim 25 wherein:

said first and second conductors are corrugated in the region between said disks and said region where said reinforcing material is attached to said electrical insulator.

29. The electrical cable of claim 25 wherein:

said first and second conductors are in the form of a loop in the region between said disks and said region where said reinforcing material is attached to said electrical insulator.

* * * * *